United States Patent [19]

George et al.

[11] Patent Number: 4,619,576

[45] Date of Patent: Oct. 28, 1986

[54] FEED SYSTEM FOR TOBACCO BLENDING/BULKING BINS

[75] Inventors: Kurudamannil A. George, Levittown; Peter E. Zagorzycki, Lansdale, both of Pa.

[73] Assignee: Proctor & Schwartz Inc., Horsham, Pa.

[21] Appl. No.: 770,319

[22] Filed: Aug. 28, 1985

[51] Int. Cl.[4] ..... B65G 15/22

[52] U.S. Cl. ..... 414/300; 198/588; 198/594; 414/272

[58] Field of Search ..... 414/177, 266, 268, 269, 414/272, 285, 288, 293, 299, 300; 198/587, 588, 594

[56] References Cited

U.S. PATENT DOCUMENTS

| | | | |
|---|---|---|---|
| 2,827,058 | 3/1958 | Bogaty | 131/108 |
| 2,834,484 | 5/1958 | Devaney et al. | 414/177 |
| 2,946,468 | 7/1960 | Hagen et al. | 414/177 |
| 3,125,231 | 6/1961 | Mortland | 214/17 |
| 3,137,398 | 6/1964 | Steffensen | 414/177 |
| 3,435,967 | 4/1969 | Sackett, Sr. | 214/17 |
| 3,528,538 | 9/1970 | Quester | 198/57 |
| 3,532,207 | 10/1970 | Quester | 198/44 |
| 3,570,650 | 3/1971 | Parsons | 414/293 X |
| 3,735,881 | 5/1973 | Wilding | 214/152 |
| 3,780,886 | 12/1973 | Allen | 214/17 |
| 3,811,585 | 5/1974 | Wilding | 214/152 |
| 3,877,585 | 4/1975 | Burgess, Jr. | 214/17 |

FOREIGN PATENT DOCUMENTS

| | | | |
|---|---|---|---|
| 1410466 | 10/1975 | United Kingdom | 414/288 |
| 265780 | 7/1970 | U.S.S.R. | 414/293 |

*Primary Examiner*—Robert J. Spar
*Assistant Examiner*—Stuart J. Millman
*Attorney, Agent, or Firm*—Richard H. Thomas

[57] ABSTRACT

A feed system for feeding light-weight materials, such as tobacco, into large blending and/or bulking bins. The present invention resides primarily in a novel, light-weight feed system comprising a trolley and a shuttle conveyor adapted to reciprocatingly feed rapidly in either a longitudinal or lateral direction with a minimum amount of inertia during acceleration and deacceleration. A feed conveyor deposits said material onto the shuttle conveyor, said feed conveyor comprising drive elements adapted to synchronize movement of the feed conveyor with movement of the shuttle conveyor. The shuttle conveyor, at least in the X direction, is unencumbered mechanically by the feed conveyor.

7 Claims, 10 Drawing Figures

FEED SYSTEM FOR TOBACCO BLENDING/BULKING BINS

TECHNICAL FIELD

The present invention relates to a feed system for feeding hard to handle or leafy materials such as tobacco into blending and/or bulking bins. The present invention is primarily useful for feeding multiple bins which are in side-by-side relationship, although the present invention is also useful for feeding a single bin.

The present invention will be described with reference to feeding tobacco into bins, but it will be apparent to those skilled in the art that the invention also has applicability for feeding other hard to handle materials such as leafy vegetables, e.g., parsley.

BACKGROUND OF THE PRESENT INVENTION

The tobacco bins of the type with which the present invention is concerned are fairly deep, more or less rectangular in cross-section, and provided with an endless belt or plate type carrying conveyor which makes up the bottom of the bin. The carrying conveyor is designed to move tobacco in the bin to the bin exit end where the relatively deep, slowly moving tobacco load is separated by a discharge picker system which causes the tobacco to discharge in a more or less uniform manner onto a more shallowly loaded, quickly moving conveyor.

Customarily, the bin is filled by an endless so-called "shuttle" conveyor which is mounted on a moveable carriage positioned above the bin and able to traverse the length and width of the bin to fill the bin with tobacco. The shuttle conveyor, in turn, is fed by a feed conveyor positioned so as to deposit tobacco on the shuttle conveyor. Depending upon location of the bin in the tobacco processing plant, the bin may be used either for blending or bulking.

Normally, there are two parts to tobacco processing; the first part being leaf processing, where the tobacco leaves which have been flue or air cured, and received from local or foreign markets, are first moistened to facilitate handling, separated into good and bad leaves, and then subjected to threshing to remove stems, to grading and, finally, screening. At this point, the tobacco is subjected to drying, reordering and packed into barrels or boxes. Between the threshing and drying steps, the plants, by way of example, may have a plurality of storage and/or surge bins, to handle several streams from the threshing process for consolidation into one stream through the drying and reordering unit. In this instance, the bins function as bulking bins.

The tobacco may remain packed in barrels or boxes for several years before being removed and further processed. In this further primary processing, the tobacco is first subjected to multiple successive blending steps, depending upon the recipe of the final product. Two common types of tobacco are air cured burley and flue cured bright. There are also flavored or straight burley tobaccos, oriental tobacco, and others, and various grades of the same. In the multiple blending steps, a plurality of bins similar to the above storage or surge bins, and feed conveyors for the same, are used to accomplish the blending, the actual blending being carried out generally by laying the different types or grades of tobacco in layers in the bin, one on top of the other. Prior U.S. Pat. No. 2,827,058 to Bogaty, dated Mar. 18, 1958, assigned to assignee of the present application, shows such a primary processing plant layout.

Although, basically, a bulking bin and a blending bin have the same overall mechanical configuration, filling the bin, depending upon whether the purpose is storage or blending, can be different. A basic difference is that, in bulking, the filling starts across the width of the bin at a starting point in the bin, for instance one end of the bin, or the center of the bin, and then proceeds in one direction or the other (towards either end,) depositing tobacco to the top or a given level of the bin. This is carried out by directing the tobacco stream relatively quickly back and forth across the width of the bin with incremental movement of the shuttle belt in said direction (toward either end) until the bin or a portion thereof is filled. By contrast, in blending, as indicated above, a relatively thin layer extending full width and, typically, full or half length in the bin is first made with one grade or type of tobacco, and then a next layer is made with another grade or type, and so on, until the bin is filled.

There are also hybrid forms of blending and bulking. For instance, a plant could be on three shifts a day, and half of the bin may be blend filled to the top in the first shift, followed by blend filling the remainder of the bin to the top in the second shift. This permits the bin to be discharged through all three shifts, since the filling takes place at a more rapid rate than the discharge. Thus, the bin would be used, in a sense, for both blending and bulking.

With regard to the specific design of the bin, the shuttle conveyor which traverses the length of the bin can be as wide as the bin, or narrower than the bin. With the use of a shuttle conveyor as wide as the bin, it is then necessary to provide a feed conveyor capable of laying a wide strip on the shuttle conveyor or capable of reciprocating, thereby laying a narrow strip down at different widthwise locations on the shuttle conveyor. An example of this apparatus is shown in prior U.S. Pat. Nos. 3,735,881 to Wilding, dated May 29, 1973 and 3,811,585, also to Wilding, dated May 21, 1974.

With the use of a fairly narrow shuttle conveyor, narrower than the width of the bin, it is necessary to provide a means for causing the shuttle conveyor to move widthwise as well as lengthwise. An example of this type of apparatus is shown in a Sacket U.S. Pat. No. 3,435,967, dated Apr. 1, 1969. It should be noted that the Sackett patent is not concerned with filling tobacco bins, but it does show a shuttle conveyor capable of both widthwise and lengthwise movement across the top of a rectangular shaped bin.

The present invention constitutes an improved apparatus of this latter type, particularly useful for filling tobacco bins.

In the Sackett apparatus, the shuttle conveyor is mounted on a first pair of trucks which in turn move longitudinally in an X-direction above the bin on longitudinally extending tracks. These tracks, in turn, are mounted on a second pair of trucks which are capable of lateral Y-movement widthwise with respect to the bin. The primary movement of the shuttle conveyor is widthwise back and forth, interrupted periodically for longitudinal, incremental shifting of the conveyor to a next filling position.

In order to feed the shuttle conveyor, the apparatus of Sackett is provided with a bridge-shaped conveyor at right angles to the shuttle conveyor, and supported by the truck system on which the shuttle conveyor rides.

This bridge conveyor is centrally located with regard to the path of travel of the shuttle conveyor so that material from the bridge conveyor automatically falls on the shuttle conveyor regardless of its position on the track system. The bridge conveyor, in turn, is fed by a delivery conveyor, all making a relatively complex, heavy or cumbersome system that has to be moved back and forth with each traverse. It should be emphasized that in the Sackett patent the bins are relatively small in size and are filled with a dense granular material which may be comparatively heavy. Thus, the rate of traverse of the feeding mechanism is relatively slow and the weight or inertia in the mechanism is as a result of little consequence.

However, in the present invention, the tobacco is relatively light weight, and the bins are by comparison very large, requiring rapid traverse, in either an X or Y direction. Thus the weight of the conveyor system which has to be moved with each traverse becomes important; particularly for rapid shuttle movement necessary in modern tobacco processing plant, to lay down many thin layers of tobacco necessary for improved consistency of a blend.

Accordingly, it is a principal object of the preent invention to provide a light-weight shuttle apparatus capable of rapid, reciprocal movement in either a longitudinal X or lateral Y direction and capable of laying relatively light-weight materials, such as tobacco, into a bin in the form of many thin layers. It is also an object of the present invention to provide a means for feeding the rapidly moving shuttle conveyor, which is capable of moving with the shuttle conveyor but which does not add to the weight or inertia of the conveyor.

In addition to the above, the prior art includes Mortland U.S. Pat. No. 3,125,231, dated Mar. 17, 1964; Quester U.S. Pat. No. 3,528,538, dated Sept. 15, 1970; Quester U.S. Pat. No. 3,532,207 dated Oct. 6, 1970; Allen U.S. Pat. No. 3,780,886 dated Dec. 25, 1973; and Burgess U.S. Pat. No. 3,877,585, dated Apr. 15, 1975.

None of the above patents suggest the concepts which constitute the present invention. The Allen patent shows a pivoting, narrow feed conveyor adapted to spread tobacco back and forth across a follow-up conveyor which, in turn, deposits the tobacco in a bin. However, the follow-up conveyor is of the same width as the bin, and for this and other reasons, the Allen patent is not an anticipation.

DISCLOSURE OF INVENTION

The present invention resides in a blending and bulking bin assembly comprising; an elongated, rectangular bin having longitudinal X and lateral Y directions; a trolley moveable longitudinally with respect to the bin; a shuttle conveyor narrower in width than the bin carried by said trolley and moveable on the trolley laterally with respect to the bin; a feed conveyor adapted to feed tobacco onto said shuttle conveyor; said feed conveyor having a moveable discharge end and a drive means adapted to synchronize movement of said discharge end with movement of the shuttle conveyor; the movement of the shuttle conveyor and trolley being unencumbered by said drive means at least in said longitudinal X direction.

In an embodiment of the present invention, the feed conveyor drive means is in the form of track means affixed to said bin extending laterally across the bin, and guide means affixed to said conveyor discharge end adapted to ride on said track means.

In an embodiment of the present invention, the feed conveyor pivots about a fixed point with respect to the bin, the feed conveyor discharge end being adapted to move to and away from the pivot point with each traverse by said discharge end.

Preferably, the blending and bulking bin assembly of the present invention is adapted for feeding leafy materials. A preferred embodiment is adapted to feed tobacco.

A principal advantage of the present invention is that the basic feed assembly which rapidly traverses the bin, particularly in the longitudinal X direction, consisting only of the trolley and shuttle, wherein the shuttle is of narrow width relative to the bin, is of much lighter weight than conventional feed assemblies, permitting movement of the component parts, e.g., the shuttle car and trolley, at a more rapid rate than in conventional assemblies. This also means that the component parts, on reversal of direction, can be deaccelerated to stop and then accelerated to operating speed in the opposite direction more quickly, in turn eliminating bin end and center buildup and providing for more uniform loading of a bin than heretofore possible. This is particularly important when the bin is being used for blending, since more uniform loading results in more uniform blending and a more consistent final product. In addition, the narrow conveyor belt is much less expensive and easier to replace when worn.

BRIEF DESCRIPTION OF DRAWINGS

The present invention and advantages thereof will become apparent upon further consideration of the following specification, with reference to the accompanying drawings in which.

BEST MODE FOR CARRYING OUT THE INVENTION AND INDUSTRIAL APPLICABILITY

Figure 1:
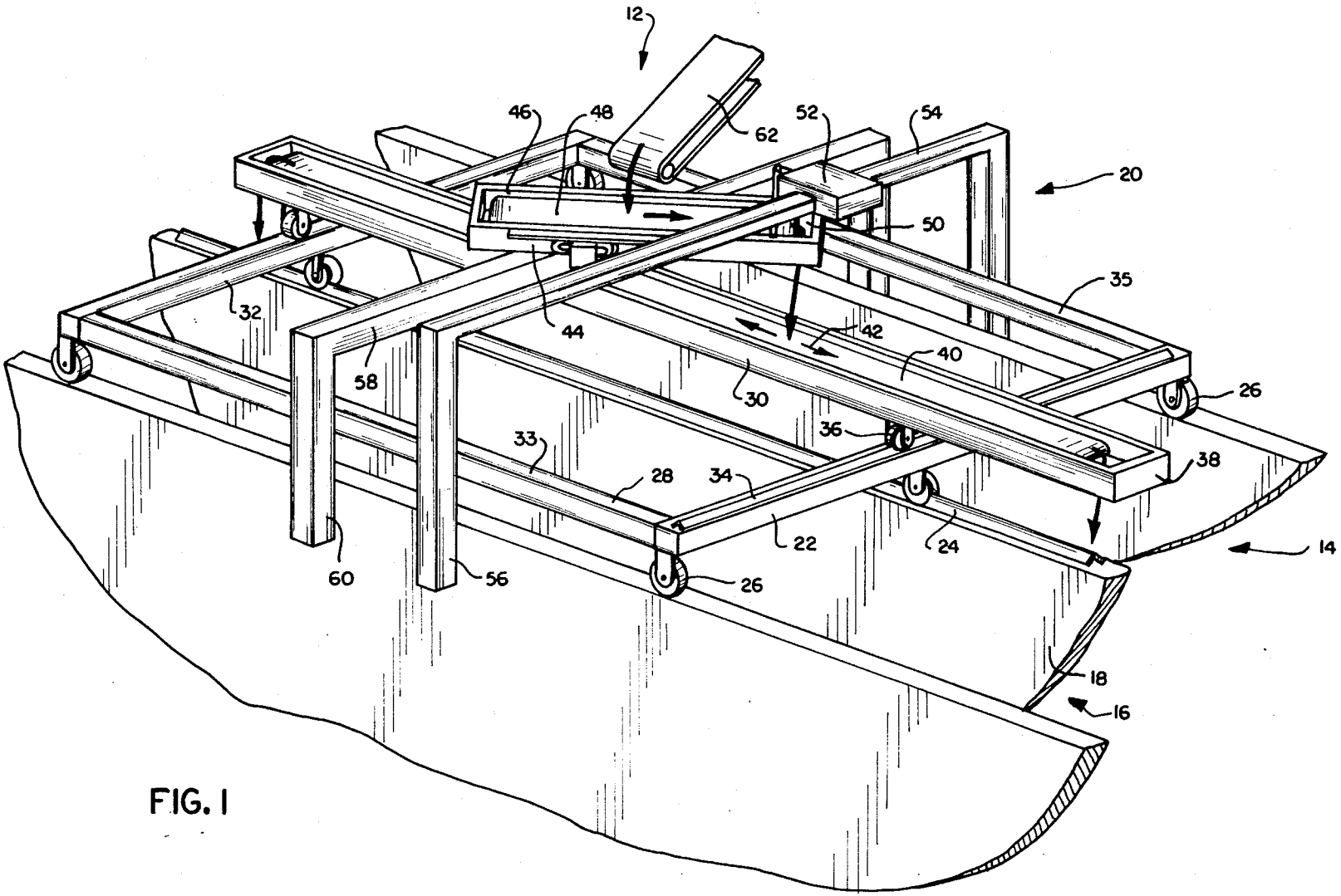
FIG. 1 is a schematic perspective view of a tobacco blending and/or bulking bin assembly according to the concepts of the present invention.
Figure 2:
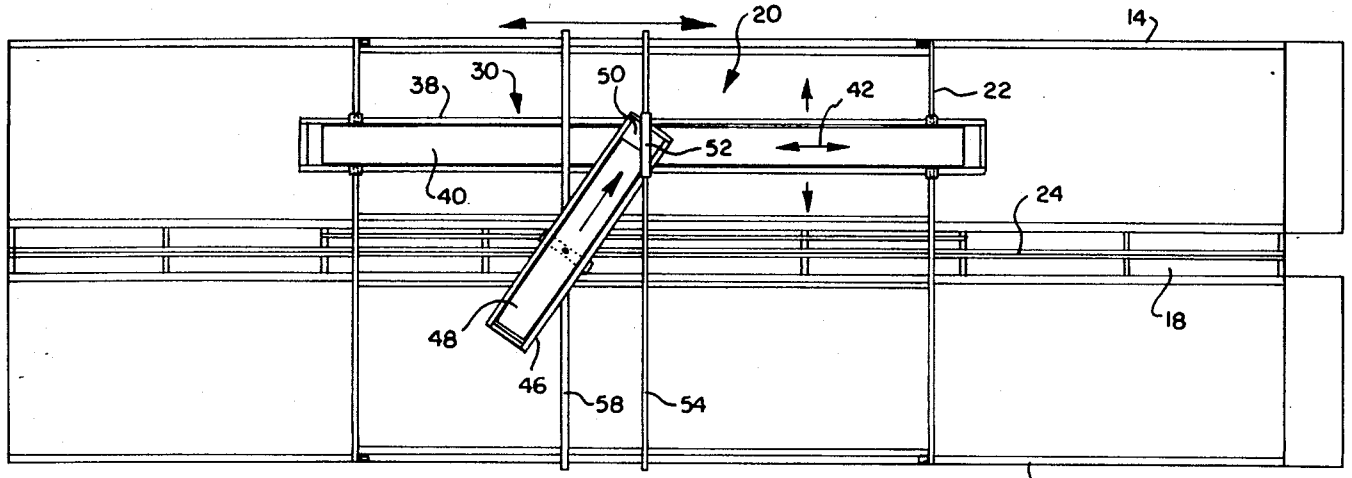
FIG. 2 is a top plan view of the bin assembly of FIG. 1.
Figure 4:
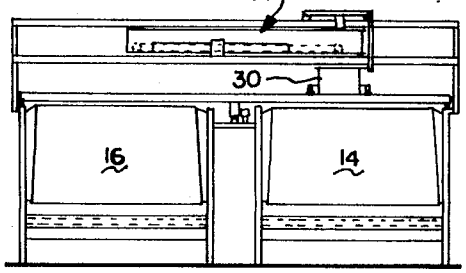
FIG. 4 is a cross-section elevation view of the bin assembly of FIG. 2, looking endwise from a point intermediate the bin end and the bin feed components.
Figure 3:
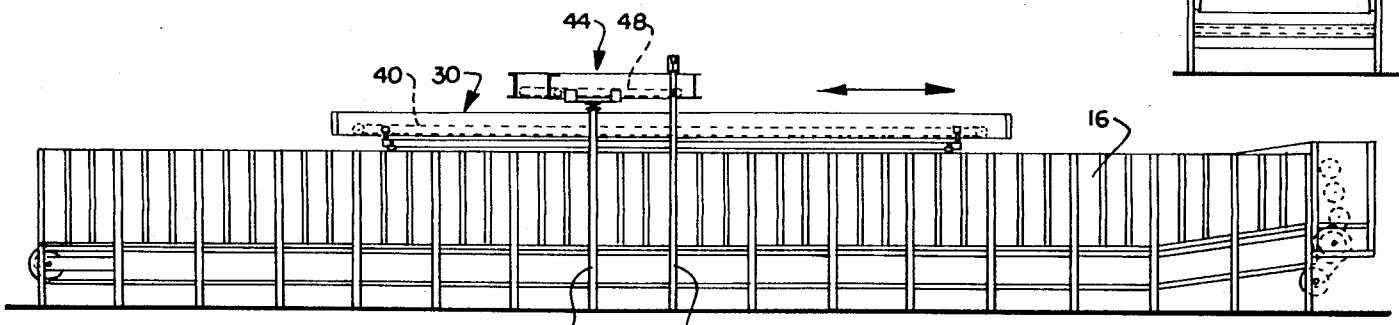
FIG. 3 is a side elevation view of the bin assembly of FIG. 2.

Referring to the drawings, and in particular FIGS. 1 and 2, the tobacco bin assembly of the present invention is broadly designated with the numeral 12. In the embodiment shown, the assembly comprises a pair of bins 14 and 16, in side-by-side relationship, sharing in this illustration a common wall 18. The feed assembly is broadly designated with the numeral 20, and comprises, as a first main component, a trolley 22 moveable in a longitudinal X direction with respect to the bins, guided by track 24 positioned on the top of the wall 18. Rollers 26 support opposite sides of the trolley and ride on the outside side walls of the bins. Essentially, the trolley is comprised of a rectangular shaped skeleton framework 28, consisting essentially of a pair of end beams 32 and 34 and a pair of side beams 33 and 35, and a motor drive mechanism, not shown, to move the trolley back and forth longitudinally along the bins. The latter includes an electric motor, and suitable rack and pinion gearing, of common construction.

Normally, the bins are very long and, particularly for blending, the trolley will be adapted for very fast longitudinal movement of or traverse by the trolley.

The second principal component of the bin feed assembly comprises a shuttle conveyor 30 which is moveable laterally on the end beams 32 and 34 of the trolley. Wheels 36 support the shuttle and ride on the end beams. The shuttle conveyor consists essentially of a rectangular framework 38 and a moveable conveyor belt 40 supported within the framework. As shown by arrows 42, the conveyor belt is moveable in opposite directions, discharging from either end of the shuttle. Drive means not shown drive the shuttle laterally on the trolley (for instance, a rack and pinion) and also drive the conveyor belt. Movement of the shuttle laterally may be incremental or indexed, or continuous, either rapid in bulking or slow in blending.

Completing the list of major components of the bin feed assembly, the third component is a feed conveyor 44 which has a framework 46, an endless belt 48, and a discharge end 50. A drive mechanism 52, to be described, is affixed to the feed belt discharge end 50 and is adapted to track the movement of the shuttle 30 and synchronize the position of the discharge end with the position of the shuttle conveyor belt 40 so that the discharge end remains above the belt 40. As will be described, the drive mechanism 52 travels on beam 54, extending laterally across and above the bins, affixed to the sides of the bins by downwardly extending legs 56.

As shown in FIG. 1, the feed conveyor 44 is supported on cross beam 58, also supported by the sides of the bins, by legs 60. The specific support for the feed conveyor is not shown in detail in FIG. 1, but in essence it constitutes a fixed pivot point. In order to adapt for lateral movement of the feed conveyor discharge end 50, the feed conveyor framework 46 is moveably supported with respect to the fixed pivot point, in a manner to be described. Thus, the discharge end 50 is moveable towards and away from the pivot point, depending upon the movement of the shuttle conveyor.

Since the feed conveyor pivot point is fixed, the feed belt itself can readily be loaded by a fixed feed arrangement, such as a fixed endless belt 62, as shown, a hopper, an air feed duct, or the like. Such a device would be supported independently from the bin assembly, and is not a part of the present invention. Its weight or support would not have to be taken into account.

FIG. 2 shows the tobacco bins 14 and 16 in full length, and from FIG. 2 it is evident that the shuttle conveyor 30 is much narrower in width than the bin, its length being about one-half the length of the bin. The shuttle is moveable longitudinally with respect to the bins, by means of trolley 22, so that it can traverse the full length of the bin, and laterally on the trolley so that it can traverse the full width of both bins and move from one bin to the next.

For loading a particular bin, the shuttle conveyor 30 can be positioned at one end, for instance the left end of a bin, and then moved to the right, either depositing tobacco off the left end of the shuttle conveyor or the right end. In the former mode, the tobacco would be laid down in the left half of the bin, starting at the left end wall, moving towards the center. In the latter mode, the tobacco would be laid down in the right half of the bin, starting from the middle and moving towards the right end wall.

Similarly, the shuttle can move back and forth in a lateral direction to fill in a desired pattern.

Two normal filling modes, as previously mentioned, are bulk filling and blending.

In bulk filling, the shuttle conveyor 30 will make rapid lateral traverses of a bin, starting the filling from one end, for instance the left end, and usually will fill to a desired level in such lateral traverses before being moved incrementally to the right.

In blending, the shuttle conveyor will usually make rapid longitudinal traverses with lateral movement during each traverse, laying down a zig-zag pattern. For instance, to put down a layer in the left half of the bin, the shuttle conveyor 40 will deposit from its left end, and, starting in the uppermost left hand corner, move to the right rapidly, with slow continuous or indexed movement at the same time downward, in the plane of the drawing, or towards the opposite bin sidewall. At the end of a traverse, or when the left end of the shuttle reaches the center of the bin, the direction of movement of the shuttle is reversed, to return the shuttle rapidly to the left end wall. Slow movement downwards, towards the opposite sidewall, continues, and the pattern is repeated until a layer is put down.

Along each sidewall, a straight longitudinal path can be made to fill along the wall.

Once a thin layer is made with one type of tobacco, a second layer may then be made with a different type, and so on.

It will be apparent to those skilled in the art that the mode of operation of the assembly may be computer or automatically controlled, and that variations and also combinations of the above patterns, can be carried out.

A significant feature of the above is that the shuttle conveyor 30, being relatively small in size, and moveable on a trolley which is light in weight, essentially a skeleton, is quickly deaccelerated after a traverse and reaccelerated for a subsequent traverse. This means that there will be little or no buildup or mounding of tobacco at the ends or in the center, as experienced with conventional loading, with the result that a layer of more uniform thickness is made.

In this regard, it was mentioned that the trolley, in essence, is composed simply of two cross beams and side beams and is little more than a skeleton. Similarly, the shuttle is basically a rectangular frame, an endless conveyor belt and little more. As shown in FIG. 2, the width of the shuttle is about one-fourth that of the bin.

As will be shown, the movement of the shuttle and trolley, at least in the longitudinal X direction, is unencumbered by the weight of the feed conveyor. Details of the feed conveyor 44, and particularly the feed conveyor at its discharge end 50, are shown in FIGS. 5, 6, and 7.

Figure 5:
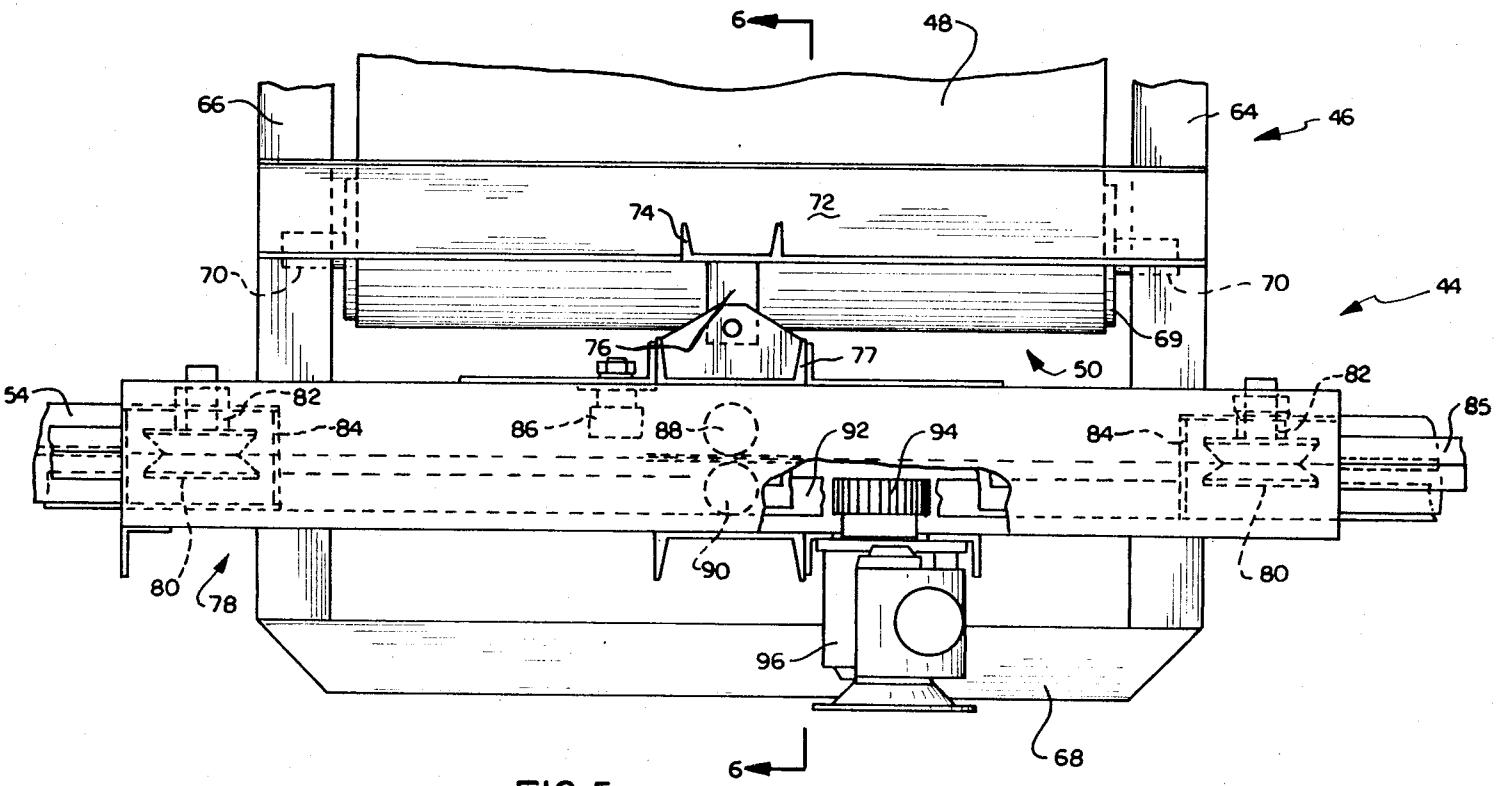
FIG. 5 is an enlarged detailed plan view partially broken away showing the discharge end of the feed conveyor component of the blending and/or bulking assembly.
Figure 6:
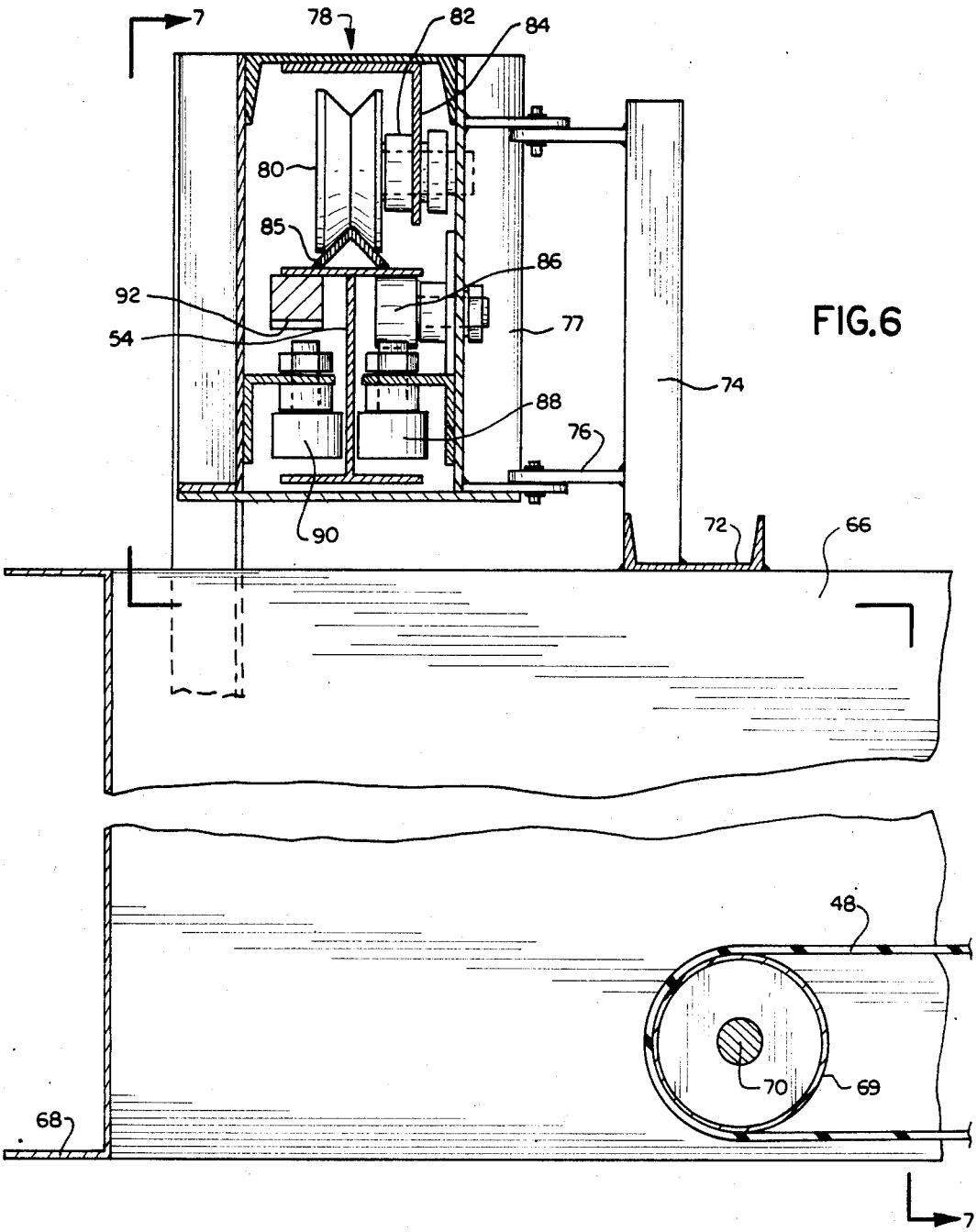
FIG. 6 is a section elevation view of the feed conveyor or assembly taken along line 6—6 of FIG. 5.
Figure 7:
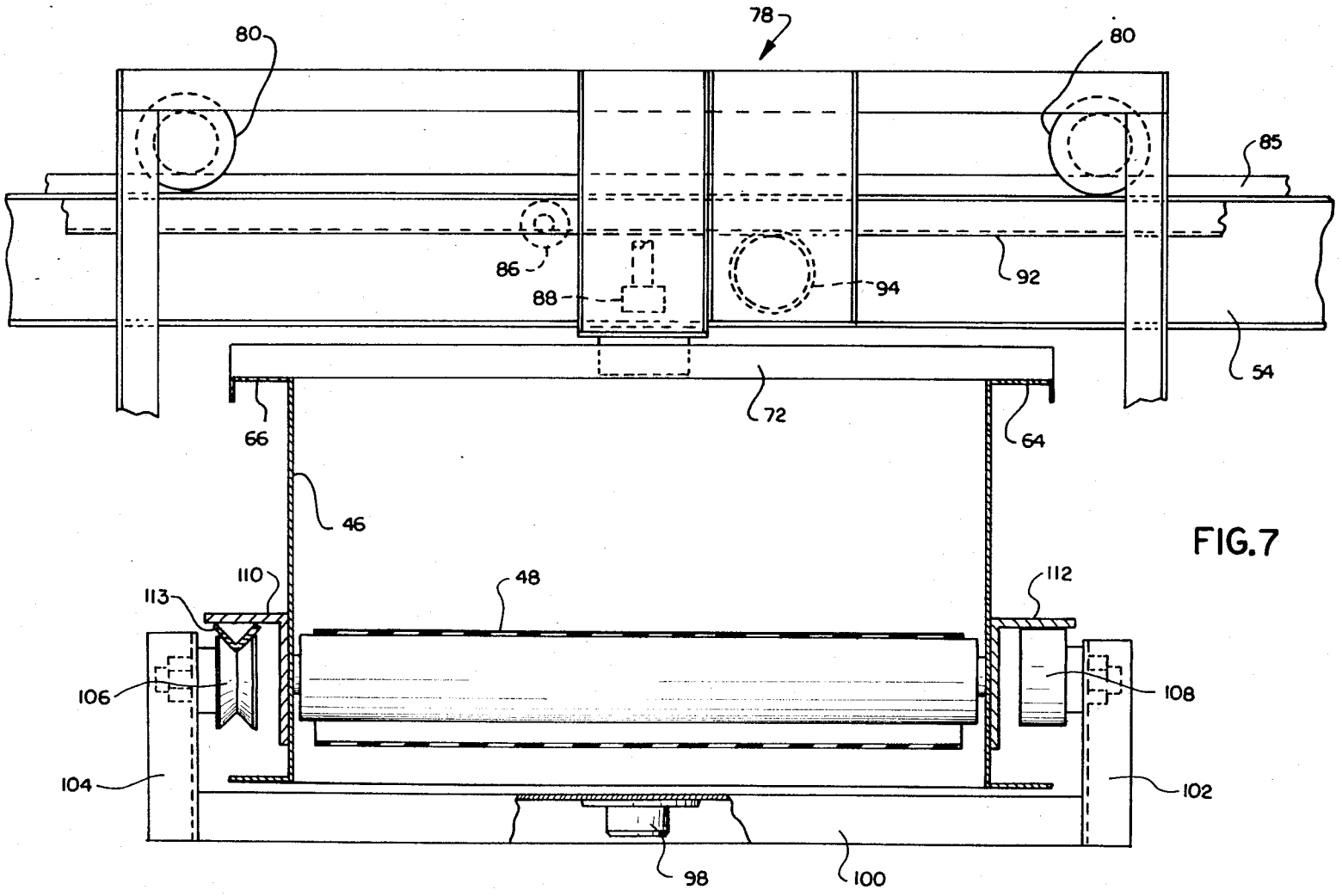
FIG. 7 is an end elevation view of the feed conveyor assembly of FIG. 5 taken along line 7—7 of FIG. 6.

Referring to FIGS. 5, 6 and 7, the framework 46 comprises side frame members 64 and 66 and end frame member 68 (FIG. 5). The endless belt 48 is mounted on roller 69 supported through trunnions 70 supported by the side frame members 64 and 66.

The discharge end of the feed conveyor is supported by means of a cross beam 72 (FIGS. 5, 6 and 7), which extends between beams 64 and 66 across the top thereof (FIG. 7), slightly inboard of the conveyor discharge end 50 (FIG. 5). An upstanding, vertical U-beam 74 is welded to the top of the cross beam 72, as shown in FIG. 6. The upstanding U-beam, in turn, is connected through a pair of vertically spaced apart pivot plates 76 (FIGS. 5 and 6) to a drive mechanism housing broadly designated with the numeral 78. The housing 78 is part of the drive mechanism 52 described above with reference to FIG. 1. Key elements of the drive mechanism include a pair of horizontally spaced apart V-rollers 80 (FIGS. 5, 6 and 7) mounted via bearing assemblies 82 (FIGS. 5 and 6) to flange 84 of the housing 78.

As shown in FIG. 5, the V-rollers 80 are positioned at opposite ends of the drive housing 78. Referring to FIG. 6, the V-rollers are adapted to ride on a V-shaped track 85, which in turn is mounted on I-beam 54, also schematically shown in FIG. 1. The I-beam and track extend widthwise across the full width of the bins, the beam 54 again being supported at its ends by legs 56 (FIG. 1) affixed to the bin sides. FIG. 7 shows I-beam 54 supporting track 85, in turn supporting rollers 80 and the feed belt discharge end through pivot plates 76 and other structure shown in FIG. 6.

To counteract the weight of the discharge end of the feed conveyor, the drive mechanism is provided with a set of three counteracting rollers 86, 88 and 90, shown in FIGS. 5 and 6, adapted to ride against opposite sides of the inner flange of the I-beam and the underside of one of the upper flanges.

The drive for the drive mechanism comprises rack 92 affixed to the underside of the upper left flange of I-beam 54 (FIG. 6). The rack is engaged by pinion 94 (FIG. 5), in turn driven by electric motor 96. The engagement of rack 92 and pinion 94 is also shown in FIG. 7.

In operation, the electric motor 96, controlled by a suitable computer, moves the feed belt discharge end back and forth laterally across the bins, through the rack and pinion drive guided by the V-rollers 80 and guide track 85. Since the drive housing 78 follows a straight path, the pivot support plates 76 are necessary to accommodate the different angles of orientation of the feed conveyor 44, pivoted about a fixed pivot point.

From the above, it is evident that the feed conveyor discharge end is actuated by a drive mechanism independent, in the sense that there is no mechanical connection, from the shuttle. To put it another way, the shuttle that has to rapidly accelerate and deaccelerate with each traverse, and rapidly execute each traverse, is unencumbered by the weight of the feed conveyor resulting in substantially less inertia in the shuttle than experienced with conventional systems.

The computer controlling the feed conveyor drive mechanism can have controls in a known manner, which enable the delivery end of the pivot feed conveyor to be always just above the longitudinally extending shuttle conveyor. For instance, to accomplish this, limit switches (not shown) may be variably positioned at opposite ends of the desired path of travel of the drive mechanism, or delivery end, and timed to provide actuation points for reversing direction of the feed belt delivery end. Delays and timing adjustments can be built into the computer controller. The number of adjustments required are brought to a minimum by the use of a synchronous motor for each of the drives involved.

Instead of moving or indexing the feed conveyor discharge end laterally with a drive means which is mechanically independent from the shuttle conveyor, it is also possible to use lateral movement of the shuttle conveyor to index or locate the feed conveyor discharge end, as long as the rapid longitudinal or X movement of the shuttle conveyor remains unencumbered. In this regard, a principal mode of operation of the feed system may comprise rapid traverse in the longitudinal X direction only, with incremental indexing or slow movement in the Y direction. In such instance, it is critical to have the movement of the shuttle conveyor unencumbered in the longitudinal X direction, but encumbered movement in the lateral Y direction where acceleration, deacceleration and inertia is not a problem, may be permissible. In this embodiment, locating pins or like means carried by the feed conveyor discharge end would engage the shuttle conveyor sides, indexing the discharge end in a lateral or Y direction, with lateral or Y movement of the shuttle conveyor, without encumbering the shuttle conveyor longitudinal movement.

Above, in the description with reference to FIG. 1, it was pointed out that the feed conveyor 44 is supported at a point removed from the discharge end on a fixed pivot point by a cross beam 58 extending across the width of the bins. In the lower part of FIG. 7, the pivot point is shown as item 98, and this pivot point supports a U-shaped framework, including a bottom cross beam 100 and upstanding side beams 102 and 104. The upstanding side beams 102 and 104, in turn, support a pair of spaced apart V-rollers 106, on one side, and a single, flat roller 108 on the opposite side. This is shown schematically in FIG. 8.

Figure 8:
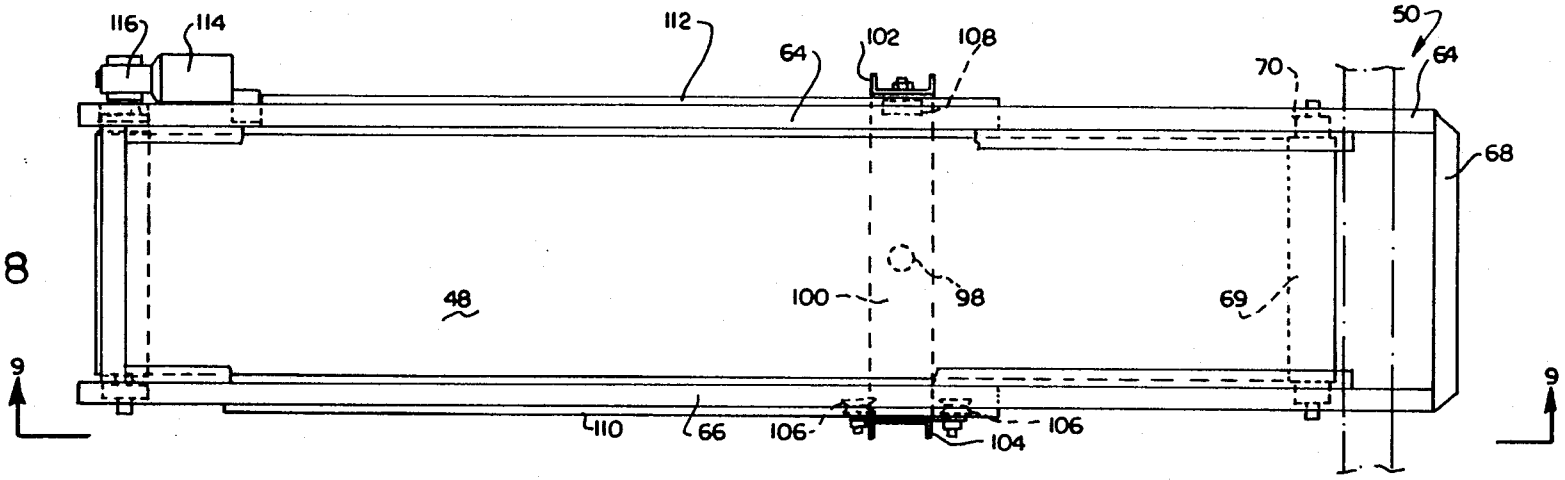
FIG. 8 is a schematic top plan view of the feed conveyor assembly of FIG. 5 showing the full assembly.

As shown in FIG. 8, the frame members 64 and 66, referred to with reference to FIG. 5, extend the full length of the feed conveyor rearwardly to the right past the rollers 106 and 108. Along the rearward (right) end of the feed conveyor, removed from the discharge end 50, the conveyor is provided with L-shaped flanges 110 and 112 (also note FIG. 7), which are affixed to the outside vertical surfaces of frame members 64 and 66 and are adapted to ride on the opposed rollers 106 and 108, the flange 110 being provided with a V-track 113 which engages the V-rollers 106 to maintain the assembly in alignment between the drive mechanism 78 and the pivot point 98. From the above, it is evident that the assembly is capable of longitudinal telescoping movement with regard to the fixed point, so that the discharge end 50 is moveable towards or away from the pivot point, depending upon the position of the shuttle belt.

Figure 9:
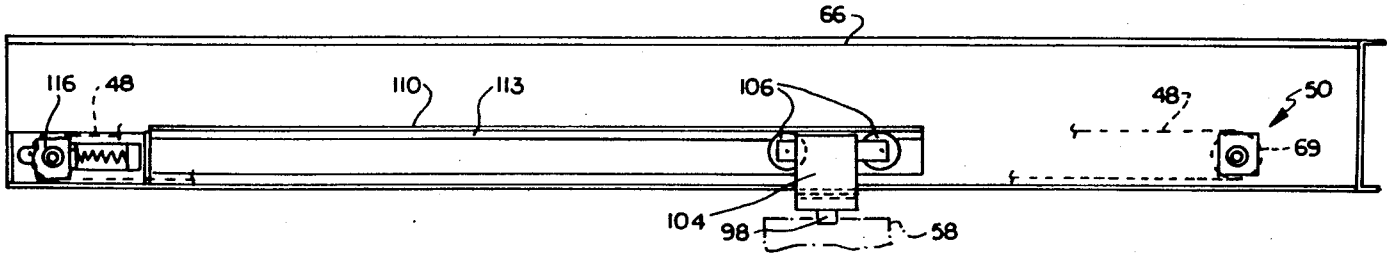
FIG. 9 is a schematic side elevation view of the assembly of FIG. 8.

In FIGS. 8 and 9, drive details of the feed conveyor belt assembly are shown. Specifically, a motor 114 drives the feed endless belt 48 through a drive 116.

Figure 10:
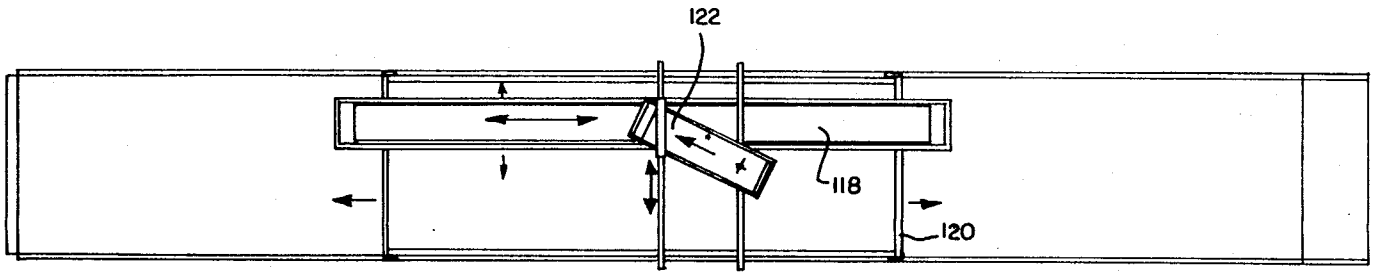
FIG. 10 is a schematic top plan view of a tobacco blending and/or bulking bin assembly employed with only one bin.

Above, the apparatus of the present invention has been described with reference to a pair of bins in side-by-side relationship. It will be apparent to those skilled in the art that the principles of the present invention are applicable to a single bin or, alternatively, to more than 2 bins, for instance 3 or 4 bins. FIG. 10 shows application of the concepts of the present invention to a single bin alone, and it should be evident from the drawing of FIG. 10 that the principles of the present invention are the same. The shuttle conveyor is shown as item 118, and is capable of both longitudinal movement and lateral movement on trolley 120. A feed conveyor 122, pivotable about a single feed point, is provided with a discharge end which tracks the movement of the shuttle belt.

The advantages of the present invention are applicable, namely, lightness in weight of the trolley and shuttle components for rapid acceleration and deacceleration, and elimination of overhang.

In an alternative embodiment, the advantages of the present invention can also be achieved with a feed conveyor which is non-pivoting in the sense that the whole conveyor assembly, rather than just the discharge end, traverses the bins in a lateral or Y direction. In this embodiment, the entire conveyor assembly is oriented or aligned with cross beam 54 (FIG. 1) and rides or is guided by the cross beam. The conveyor has an endless belt, a discharge end and a reversible drive means to continuously position the discharge end above the shuttle conveyor. Similarly, a fixed hopper, or other such means, deposits product onto the feed conveyor belt, the belt having a length sufficient that regardless of the position of the shuttle, a portion of the belt is positioned beneath the hopper. The important aspect of this embodiment is that the drive means for movement of the feed mechanism is, as with the embodiment described above, a mechanically independent apparatus, at least in the longitudinal X direction. In other words, in this embodiment also, the shuttle is unencumbered, at least in the X direction, by the feed conveyor or any part thereof during rapid traverses.

This embodiment is used with multiple bin installations where there are obstructions between bins interfering with free trolley movement. In these instances, the trolley is split into separate units for each bin, each trolley carrying its own shuttle; and being dimensioned so that it does not extend substantially beyond the bin side walls.

The feed conveyor belt is reversible in that it is capable of discharge from either end of the feed conveyor, depending upon which bin, or bin shuttle is being loaded. Controls continually position one or the other of the discharge ends over the shuttle conveyor being loaded.

We claim:

1. A blending and bulking bin assembly comprising (a) an elongated, rectangular bin having longitudinal X and lateral Y directions;

(b) a trolley movable longitudinally with respect to the bin;

(c) a shuttle conveyor carried by said trolley and moveable laterally on the trolley with respect to the bin;

(d) an endless conveyor belt carried by said shuttle conveyor;

(e) a feed conveyor adapted to feed tobacco onto said shuttle conveyor belt, said feed conveyor having a movable discharge end;

(f) drive means mechanically independent from the shuttle X direction of movement affixed to said feed conveyor discharge end to move said discharge end laterally to coincide with lateral movement of the shuttle conveyor.

2. A blending and bulking bin assembly for tobacco comprising (a) at least two side-by-side rectangular bins having the same longitudinal and lateral directions;

(b) a trolley movable longitudinally with respect to said bins;

(c) a shuttle conveyor carried by said trolley and moveable laterally on the trolley with respect to the bin;

(d) an endless conveyor belt carried by said shuttle conveyor (e) a pivoting feed conveyor having a fixed pivot point and a feed belt discharge end removed from the pivot point and movable with respect to said pivot point;

(f) a laterally extending track means; and (g) guide means moveable on said track means affixed to said feed belt discharge end maintaining the lateral position of said discharge end coincident with the lateral position of said shuttle conveyor belt.

3. The bin assembly of claim 2 wherein said laterally extending track means is affixed to said bins.

4. The bin assembly of claims 1 or 2 wherein said shuttle conveyor is substantially narrower in width than the bins.

5. The bin assembly of claim 4 wherein said shuttle conveyor width is about one fourth the width of the bins.

6. The assembly of claims 2 wherein said pivoting feed conveyor comprises a first framework for said guide means and a second framework for said discharge end, and means pivotally connecting said first and second frameworks.

7. The assembly of claim 6 wherein said second framework comprises first and second sections in telescoping relationship with respect to each other, the first section containing said pivot point and the second section said discharge end.

* * * * *